US009056483B1

(12) United States Patent
Ahn et al.

(10) Patent No.: US 9,056,483 B1
(45) Date of Patent: Jun. 16, 2015

(54) APPARATUS AND METHOD OF TRANSFERRING, FOCUSING AND PURGING OF POWDER FOR DIRECT PRINTING AT LOW TEMPERATURE

(71) Applicant: SNU R&DB FOUNDATION, Seoul (KR)

(72) Inventors: Sung-Hoon Ahn, Seongnam-si (KR); Gil-Yong Lee, Seoul (KR)

(73) Assignee: SNU R&DB FOUNDATION, Seoul (KR)

( * ) Notice: Subject to any disclaimer, the term of this patent is extended or adjusted under 35 U.S.C. 154(b) by 13 days.

(21) Appl. No.: 14/177,309

(22) Filed: Feb. 11, 2014

(30) Foreign Application Priority Data

Dec. 24, 2013 (KR) ..... 10-2013-0162573

(51) Int. Cl.
*B41J 2/195* (2006.01)
*B41J 2/175* (2006.01)

(52) U.S. Cl.
CPC ..... *B41J 2/17563* (2013.01); *B41J 2/17596* (2013.01)

(58) Field of Classification Search
USPC ..... 347/7, 83–85, 89, 93, 97
See application file for complete search history.

(56) References Cited

U.S. PATENT DOCUMENTS

| | | | | |
|---|---|---|---|---|
| 8,100,500 | B2 * | 1/2012 | Bansyo | 347/7 |
| 8,556,395 | B2 * | 10/2013 | Hiratsuka et al. | 347/85 |
| 8,833,897 | B2 * | 9/2014 | Murata et al. | 347/35 |
| 2009/0322818 | A1 * | 12/2009 | Iwasaki | 347/14 |

* cited by examiner

*Primary Examiner* — Kristal Feggins
(74) *Attorney, Agent, or Firm* — Lexyoume IP Meister, PLLC

(57) ABSTRACT

Disclosed herein are apparatus and method for transferring, focusing and purging powder for direct printing at low temperature. A filter is provided between an operation chamber housing in which a work target is disposed and a reservoir tank which contains powder to adjust the amount of particles transferred from the reservoir tank into the operation chamber housing. A pressure unit connected to the reservoir tank generates air pressure for applying powder to the work target. A purging unit connected to the reservoir tank generates pressure for returning powder that has remained in the operation chamber housing, the filter, etc. to the reservoir tank after work has been completed. The apparatus is configured such that a series of process of transferring powder to be applied to the surface of the work target and returning remnant powder to the reservoir tank can be rapidly and smoothly conducted.

19 Claims, 14 Drawing Sheets

(a) (b)

APPARATUS AND METHOD OF TRANSFERRING, FOCUSING AND PURGING OF POWDER FOR DIRECT PRINTING AT LOW TEMPERATURE

BACKGROUND OF THE INVENTION

1. Field of the Invention

The present invention relates generally to apparatuses and methods for transferring, focusing and purging powder for direct printing at low temperature and, more particularly, to an apparatus and method for transferring, focusing and purging powder for direct printing at low temperature which are configured to rapidly and smoothly conduct a series of processes for directly printing metal or ceramic powder on a substrate in a variety of patterns at a micro scale at low temperature without conducting additional heat treatment: aerosolizing powder through a momentary pulse type valve control, discharging a desired amount of powder through a nozzle, directly applying the powder to the surface of a work target such as a substrate in a focused form to print a desired pattern, stabilizing powder after discharge of the desired amount of powder has completed, and then returning the powder.

2. Description of the Related Art

Inkjet printing and direct printing technology using liquefied ink in a manner similar to that of the inkjet printing are used to precisely print a predetermined material on a substrate in a desired pattern.

Recently, studies on methods of manufacturing a variety of machines, electric elements or apparatuses in such a way that a desired pattern is directly printed at a desired position on a substrate using such a direct printing technology are actively being undertaken.

In such a printing technology, liquefied ink is used, and a piezo-actuator or the like is typically used to apply an ink droplet onto a substrate through a nozzle using the viscosity of ink.

However, the printing technology using ink is disadvantageous in that additional heat treatment is required because liquefied ink is used, it is difficult to produce a print result structure having a high aspect ratio, and it must depend on a wet process.

In an effort to overcome the above-mentioned problems, a method has been proposed, in which powder having micro- or nanometer-sized particles is discharged along with high-pressure transfer gas from a nozzle and is deposited on the surface of a substrate.

In detail, techniques such as an aerosol deposition method, a cold spray deposition method, a nano-particle deposition system, etc. are known. In these techniques, dry solid powder is accelerated by high-pressure transfer gas and is discharged from a nozzle, thus forming a functional pattern or a thin film on a substrate.

Generally, particles accelerated by high-pressure transfer gas to a high speed of several hundreds m/s or more collide with a substrate at high speed because of the force of inertia. On high speed collision a high-temperature area is partially formed on the surface of each particle.

As high-temperature areas are partially formed on the surfaces of the particles, when fine particles are deposited, very strong bonding force is applied between the particles, and they are very densely deposited.

Metal powder or ceramic powder is typically used as the fine particles. Particles such as polymer particles are also reported as producing promising deposition results.

Furthermore, with regard to the substrate, it is being reported that different kinds of powder can be deposited on a variety of substrates.

These techniques are advantageous in that a dry process can be used, and solid particles can be deposited on a substrate at low temperature or room temperature. However, cases where these techniques are used to directly print a precise pattern on a substrate are still rare.

The reason for this is because it is difficult to use transfer gas to form uniformly-dispersed particles from powder, that is, aerosolized powder in transfer gas, aeromechanically control a flow rate of aerosolized powder and a transfer timing of aerosolized powder, and accelerate particles at high speed and precisely deposit them on a portion of a substrate.

Furthermore, with regard to the conventional cold spray deposition process or the like, technical development and studies on deposition of various kinds of powder on a large area of a substrate have been mainly conducted, rather than on the application technique.

The following problems should be solved to deposit particles and precisely and directly print a very small sized pattern on a substrate using the conventional technique such as the above-mentioned cold spray deposition or the like.

Fine particle type powder must be enabled to be immediately aerosolized at a desired moment, the amount of particles transferred to a nozzle and a substrate and a transfer timing must be precisely controlled, and the transfer of aerosolized powder must be stabilized and the supply thereof must be interrupted immediately after a desired degree of printing process has been completed so that a small sized pattern can be printed.

Further, to precisely and directly print on a very small sized pattern on a substrate using particles, the particles must be enabled to be applied from the nozzle onto the substrate in a focused form. After a desired amount of particles has been discharged from the nozzle, the remaining powder must be rapidly stabilized such that the discharge operation is reliably finished.

In the conventional cold spray deposition method or the conventional method in which solid powder or particles are carried on transfer gas and deposited on a substrate, the transfer gas is typically provided from high-pressure compressed gas at a constant flow rate.

In a process of these conventional methods, because the speed of transfer gas and the speed of particles accelerated by the transfer gas must be increased and collision speed by the force of inertia must be increased so as to the quality of deposition, transfer gas having a high pressure of several tens MPa or more is used, or a vacuum chamber is used in such a way that a low pressure side is decompressed to be at a negative pressure so that a pressure difference between a high pressure side from which transfer gas is supplied and the low pressure side in which the substrate is disposed can be increased.

In the case of the cold spray deposition, high-pressure transfer gas of several tens Mpa or more is used, and a portion in which the substrate is disposed is maintained at atmospheric pressure.

In the aerosol deposition method or nano-particle deposition system, the deposition operation is conducted in a vacuum chamber, and transfer gas of several bar is typically used.

However, these conventional methods are problematic in that since transfer gas is continuously supplied only at a constant flow rate, it is difficult to increase a pressure difference, to a certain level, between a transfer gas supply side of high pressure and the substrate maintained at low pressure.

To solve the above-mentioned problem, a method, in which an area including a space in which a base material is disposed is intermittently sealed so that decompression can be intermittently amplified whereby a collision speed of aerosolized powder can be increased, was proposed in Korean Patent Application No. 10-2007-0002024.

Similarly, in Korean Patent Laid-open Publication No. 10-2008-0009160, a high pressure side and a low pressure side (atmospheric pressure) are separated from each other by a separation film (on-off valve). When the separation film is momentarily removed (the valve is momentarily opened), compression waves or shock waves are transmitted from the high pressure side to the low pressure side, whereby transfer gas and particles to be deposited on a substrate can be more effectively accelerated.

From these modified conventional patent applications, it can be appreciated that particles can be more effectively accelerated and a more satisfactory deposition result can be obtained in such a way that the high pressure side from which transfer gas is supplied and the lower pressure side in which powder and the substrate are disposed are separated from each other by an appropriate method, and a means for separating the high-pressure side and the low-pressure side from each other is momentarily and temporarily removed so as to accelerate transfer gas and particles.

However, although these modified conventional techniques can be easily used for large area deposition and coating, research and development on reducing the size of a deposition pattern and controlling the shape of the pattern and the position of deposition have not been sufficient.

In the conventional methods in which particles are accelerated by transfer gas and deposited on a substrate and in the modified conventional methods, critical problems in printing a precise pattern (mircroscale) on a substrate are that the amount of aerosolized powder supplied or sprayed onto the substrate for deposition is large, and research and development of a technique of controlling it has not been sufficient.

Direct printing techniques such as inkjet printing can manufacture a precise pattern, because ink droplets can be supplied by stages with the minimum amount necessary to manufacture the pattern.

However, with regard to the modified methods in which particles are deposited on a substrate in such a way as to accelerate them using transfer gas, research and development on a technique of supplying, by steps, the minimum amount aerosolized powder necessary to manufacture a precise pattern and controlling the size of the deposition pattern have been unsatisfactory.

PRIOR ART DOCUMENT

Patent Document (Patent document 1) Korean Patent Laid-open Publication No. 10-2008-0009160

(Patent document 2) Korean Patent Application No. 10-2007-0002024

SUMMARY OF THE INVENTION

Accordingly, the present invention has been made keeping in mind the above problems occurring in the prior art, and an object of the present invention is to provide apparatus and method for transferring, focusing and purging powder for direct printing at low temperature which can precisely and directly print a desired pattern on a desired portion of a substrate even at low temperature in such a way that solid powder or particles are accelerated by transfer gas.

Another object of the present invention is to provide apparatus and method for transferring, focusing and purging powder for direct printing at low temperature in which when particles are deposited on a base material or substrate by accelerating the particles using transfer gas, the amount and timing that the particles, in detail, the particles dispersed in the transfer gas, that is, the aerosolized particles, are supplied onto the substrate can be effectively controlled, whereby a precise pattern can be reliably formed on the substrate without using an additional tool such as a mask.

A further object of the present invention is to provide apparatus and method for transferring, focusing and purging powder for direct printing at low temperature in which a required amount of aerosolized powder supplied and discharged from a high pressure side to a low pressure side at high speed is minimized, the timing at which the aerosolized powder is supplied to the substrate is precisely controlled, and these printing operations are repeatedly conducted by steps, whereby a pattern can be precisely printed.

In order to accomplish the above object, the present invention provides an apparatus for transferring, focusing and purging powder for direct printing at low temperature in which a high pressure side and a low pressure side are separated from each other by an on-off means (on-off valve or the like), and decompression of the low pressure side is induced by repeating momentary opening and closing of the on-off means so that a pressure difference between the high pressure side and the low pressure side can be further increased to enhance the ability to accelerate particles, and which is configured such that the on-off timing of the valve is controlled in consideration of particle acceleration dynamic characteristics depending on transfer gas, whereby the supply of aerosolized powder, the injection quantity thereof and the supply timing can be precisely controlled.

According to the present invention having the above-mentioned construction, metal, ceramic or polymer powder or particles can be applied on a substrate to form a precise pattern through a low-temperature and dry process without additional heat treatment.

As proposed in the prior art documents, in a transfer gas supply method in which an on-off means between a high pressure side and a low pressure side is repeatedly opened and closed by a pulse control method, acceleration characteristics of transfer gas and particles can be obtained to some degree. However, the prior art documents are focused on only effective deposition of particles through repetition of the opening and closing of the of-off means. On the other hand, in the present invention, as well as using the pulse control opening and closing method, the supply of aerosolized powder, the injection quantity thereof and the supply timing can be controlled. Thereby, a pattern can be precisely printed on a substrate without using a separated mask.

Furthermore, particles can be discharged from a nozzle by transfer gas in a focused form by selecting an appropriate shape of an injection nozzle. It could be configured from a test that when aerosolized powder is applied from the nozzle to the substrate by a momentary pulse control method, such focusing effect can be further enhanced.

The amount of aerosolized powder required to be supplied to the substrate by the momentary pulse control method of opening and closing the high pressure side and the low pressure side, in more detail, the amount of particles supplied for deposition, can be minimized. Because aerosolized powder is discharged from the nozzle in a focused form and applied to the substrate, a technique of printing a precise pattern at low temperature using dry and solid particles can be embodied.

BRIEF DESCRIPTION OF THE DRAWINGS

The above and other objects, features and advantages of the present invention will be more clearly understood from the following detailed description taken in conjunction with the accompanying drawings, in which:

FIGS. 10A and 10B show the behavior of powder that is focused on the injection nozzle and discharged therefrom in the powder transferring, focusing and purging apparatus according to an embodiment of the present invention, wherein FIG. 10A is a schematic conceptual sectional view, and FIG. 10B is a photograph showing the behavior of powder captured by a high speed camera;

DESCRIPTION OF THE PREFERRED EMBODIMENTS

Hereinafter, preferred embodiments of the present invention will be described in detail with reference to the attached drawings.

Figure 1:
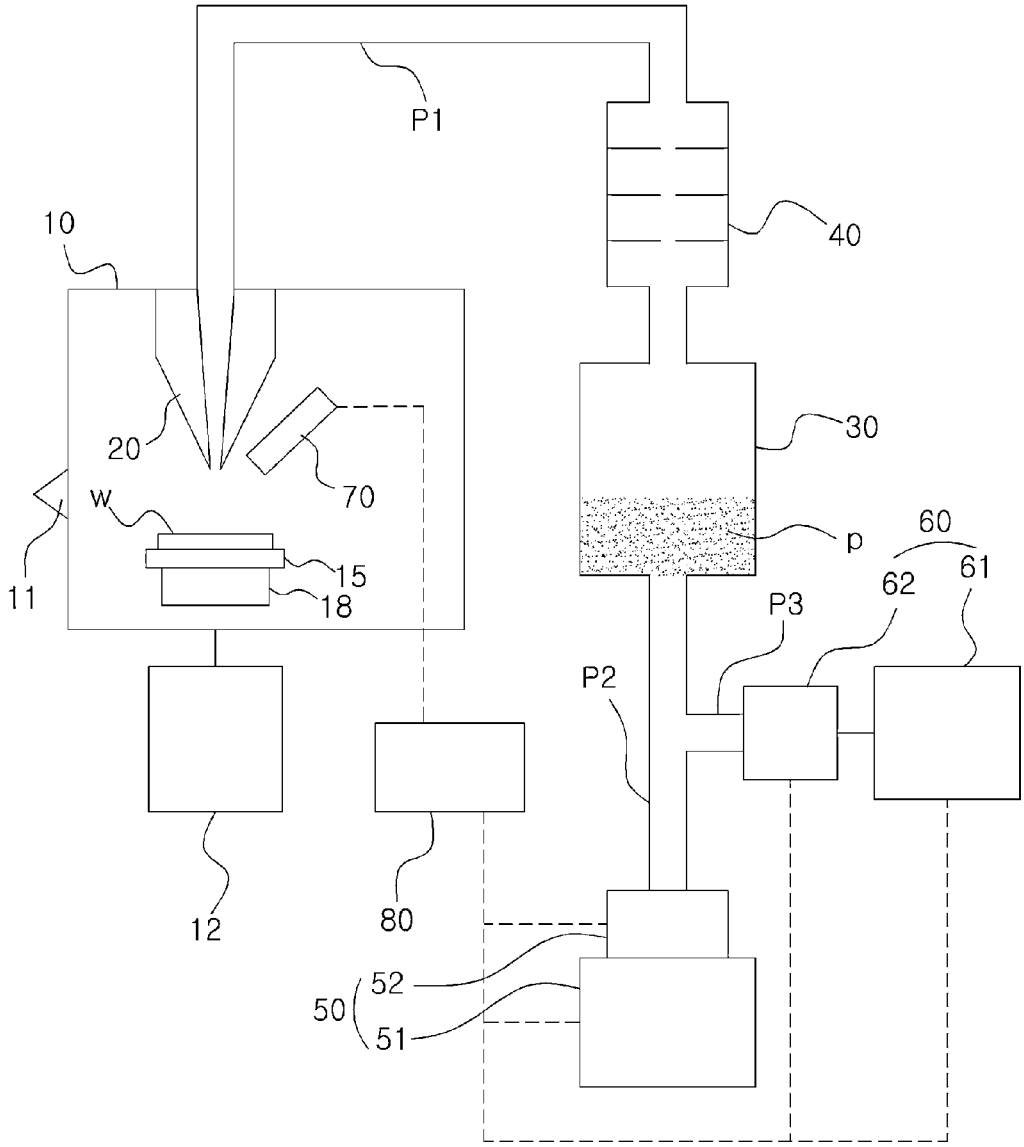
FIG. 1 is a schematic view illustrating the construction of an apparatus for transferring, focusing and purging powder for direct printing at low temperature, according to an embodiment of the present invention.

FIG. 1 is a schematic view illustrating the construction of an apparatus for transferring, focusing and purging powder for direct printing at low temperature, according to a preferred embodiment of the present invention.

For reference, in FIG. 1, reference numeral 11 denotes a vacuum gauge.

As shown in FIG. 1, the apparatus according to the present invention includes an operation chamber housing 10, an injection nozzle 20, a reservoir tank 30, a filter 40, a pressure unit 50 and a purging unit 60.

The operation chamber housing 10 defines therein a space for receiving a work target w and creates a vacuum environment, in detail, maintains the internal space in a predetermined negative pressure state (e.g., ranging from $10^{-2}$ torr to $10^{-6}$ torr).

For example, the work target w may be a substrate, in more detail, a PCB (printed circuit board), a polymer substrate including PET (polyethylene terephthalate) and PMMA (polymethyl methacryalate), a metal substrate, a substrate made of ceramic, a glass substrate, a paper substrate, etc.

The injection nozzle 20 is installed in the operation chamber housing 10 and applies powder p onto the work target w at high pressure.

The injection nozzle 20 is a converging nozzle or a capillary nozzle which is constant in a cross-sectional area thereof and is configured such that particles can be focused. The diameter of an outlet of the injection nozzle 20 ranges from 10 μm to several mm.

The power p is metal powder, ceramic powder, polymer powder or a mixture of them which is made of material selected from the group consisting of tin, copper, gold, silver, platinum and a mixture of at least one among them Of course, as well as the above-stated kinds of metal, most kinds of metal such as steel, nickel, aluminum, titanium, etc. can be used as the power p.

The work target w such as a basic material or substrate which is a target for deposition or printing is disposed adjacent to the outlet of the injection nozzle 20.

The reservoir tank 30 is connected to the operation chamber housing 10 by a first pipe P1 and has an internal space for containing powder P. A lower portion of the internal space is under higher pressure than an upper portion thereof.

That is, because the operation chamber housing 10 is maintained in the negative pressure state, the outlet side of the injection nozzle 20 becomes the end of a negative pressure side while the bottom of the reservoir tank 30 becomes the end of a high pressure side.

The filter 40 is provided on the first pipe P1 between the operation chamber housing 10 and the reservoir tank 30 so as to adjust the amount of particles transferred from the reservoir tank 30 into the operation chamber housing 10.

The pressure unit 50 is closeably connected to the reservoir tank 30 by a second pipe P2. Using a pressure difference between the operation chamber housing side, that is, the outlet side of the injection nozzle 20, which is the low pressure side based on to the upper and lower portions of the reservoir tank 30 and the bottom side of the reservoir tank 30 which is the high pressure side, when the pressure unit 50 is opened, in detail, when a flow rate control valve 52 of the pressure unit 50 which will be described in detail herein below is opened, the pressure unit 50 transmits compression waves or shock waves resulting from collapse of the above-mentioned pressure difference to the powder p, thus accelerating the powder p and aerosolizing it.

The purging unit 60 is connected to the reservoir tank 30 by a third pipe P3. When the operation of printing on the work target w is interrupted by closing the pressure unit 50, the purging unit 60 returns transfer gas, which has been mixed with the aerosolized powder P that remains in the operation chamber housing 10, the filter 40 and the pipes, to the outside of the reservoir tank 30.

Therefore, in the present invention, the operation in which the pressure unit 50 is closed and the purging unit 60 is operated, and the operation in which the purging unit 60 is interrupted and the pressure unit 50 is opened can be conducted at the same time. Thereby, transfer and return of powder p can be rapidly and successively performed immediately.

In the present invention, not only the above-mentioned embodiment but also the following different kinds of embodiments can be realized.

Preferably, the apparatus according to the present invention further includes a second suction rotary pump 12 which is connected to the second suction rotary pump 12 to create vacuum in the internal space of the operation chamber housing 10.

The second suction rotary pump 12 is preferably designed such that suction pressure thereof is less than that of a first suction rotary pump 61 of the purging unit 60 which will be explained later herein so as not to impede the suction of powder p that remains in the operation chamber housing 10, the first pipe P1 or the filter 40.

Preferably, the apparatus further includes a support plate 15 and a phase change assembly 18 which are provided in the operation chamber housing 10 to position the work target w in the operation chamber housing 10 and make work smooth and easy.

The support plate 15 is installed in the operation chamber housing 10, and the work target w is placed on the support plate 15.

Installed in the operation chamber housing 10, the phase change assembly 18 is connected to the support plate 15 to move the support plate 15 in three axis directions, that is, forwards, backwards, leftwards, rightwards, upwards and downwards.

Although it is not shown in detail, the phase change assembly 18 may have a linear guide structure which can perform three-axial control in response to installation conditions of the work target w and deposition conditions of powder P.

Also, although it is not illustrated in detail, for example, the phase change assembly 18 may be embodied in such a way that a ball joint is provided under a lower surface of the support plate 15, and a plurality of cylinders or extendable members which can be adjusted in length are provided on the perimeter of the lower surface of the support plate 15. In this way, the inclination of the support plate 15 can be adjusted, and the support plate 15 can be rotated with respect to all directions, whereby powder p can be deposited on the surface of the work target w in a variety of forms (refer to FIGS. 5 an 6).

Meanwhile, the apparatus according to the embodiment of the present invention further includes a visual recognition unit 70 and a controller 80 to observe, in rear time, conditions in which powder p is deposited onto the work target w and easily control operation and interruption of the pressure unit 50 and the purging unit 60.

In detail, the visual recognition unit 70 is installed in the operation chamber housing 10 to check, in real time, conditions in which powder p is applied onto the work target w and deposited thereon. For instance, an optical microscope or a scanning electron microscope can be used as the visual recognition unit 70.

The controller 80 is electrically connected to the pressure unit 50, the purging unit 60 and the visual recognition unit 70 and is used to control the operation and interruption of the pressure unit 50 and the purging unit 60 in response to recognition information of the visual recognition unit 70.

Meanwhile, the operation chamber housing 10, the injection nozzle 20, the reservoir tank 30, the filter 40, the pressure unit 50 and the purging unit 60 which are significant parts of the apparatus according to the embodiment of the present invention are connected to each other by the pipes, as stated above. The pipes include the first pipe P1, the second pipe P2 and the third pipe P3.

The first pipe P1 connects the operation chamber housing 10 to the reservoir tank 30. The second pipe P2 connects the pressure unit 50 to the reservoir tank 30. The third pipe P3 branches off from the second pipe P2, and the purging unit 60 is connected to the third pipe P3.

As stated above, the pressure unit 50 applies powder transferring pressure to the operation chamber housing 10 and controls the pressure. The pressure unit 50 includes a first compressor 51 and a flow rate control valve 52.

The first compressor 51 is coupled to an end of the second pipe P2 that is connected to the reservoir tank 30 and a technical means for generating compressed air so that the powder p can be discharged from the injection nozzle 20 of the operation chamber housing 10 at high pressure.

The flow rate control valve 52 is provided on the second pipe P2 and opens or closes it so as to isolate the pressure of compressed air generated from the first compressor 51 or release it. The flow rate control valve 52 is a kind of solenoid valve which is configured such that applied air pressure can be appropriately controlled in response to the degree of opening of the valve.

The first compressor 51 and the flow rate control valve 52 are operated under control of the controller 80 in response to real time visual recognition information of the visual recognition unit 70.

Meanwhile, as stated above, the purging unit 60 functions to generate suction pressure to return powder p that has remained in the operation chamber housing 10, the first pipe P1 and the filter 40 to the reservoir tank 30 after the operation using powder p has been completed. The purging unit 60 includes the first suction rotary pump 61 and a first purging valve 62.

The first suction rotary pump 61 is coupled to an end of the third pipe P3 that branches off from the second pipe P2 connected to the reservoir tank 30. The first suction rotary pump 61 is a technical means for generating suction pressure to return powder p to the reservoir tank 30.

The first purging valve 62 is provided on the third pipe P3 and opens or closes it so as to isolate suction pressure resulting from the operation of the first suction rotary pump 61 or release it. The first purging valve 62 is a kind of solenoid valve which is configured such that applied air pressure can be appropriately controlled in response to the degree of opening of the valve.

The first suction rotary pump 61 and the first purging valve 62 are also operated under control of the controller 80 in response to real time visual recognition information of the visual recognition unit 70.

Hereinafter, the operation of accelerating powder p and aerosolizing it in the apparatus for transferring, focusing and purging powder for direct printing at low temperature, according to the embodiment of the present invention will be explained in detail with reference to FIG. 2.

Figure 2:
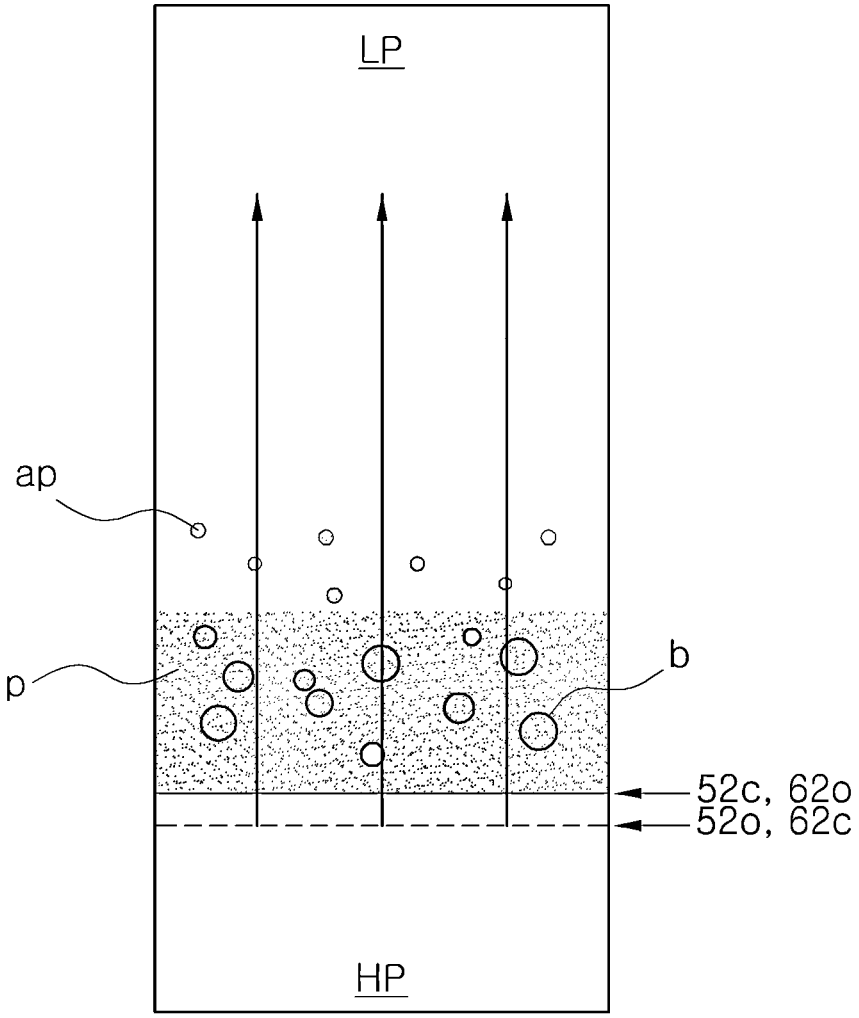
FIG. 2 is a conceptual view schematically showing aerosolization of powder resulting from accelerating the powder in the apparatus according to the embodiment of the present invention.

FIG. 2 is a conceptual view schematically showing aerosolization of powder resulting from accelerating the powder in the apparatus according to the embodiment of the present invention.

It can be appreciated that a portion designated by a rectangular solid line of FIG. 2 is a schematically simplified representation of a space from the reservoir tank 30 to the outlet of the injection nozzle 20.

According to Stokes law, small particles or low density particles are accelerated by transfer gas and, in detail, they are accelerated and dispersed in a form of gas by transfer gas that is accelerated by shock waves or compression waves which are generated by opening the flow rate control valve 52 of the pressure unit 50 and are transmitted from the bottom side of the reservoir tank 30 that is a high pressure (HP) side to the end side of the injection nozzle 20 that is a low pressure (LP) side.

Small particles of powder p that are dispersed in a form of gas are used as aerosol for deposition or printing. The aerosol is supplied to the injection nozzle 20 through the first pipe p1 that connects the reservoir tank 30 to the injection nozzle 20, before being discharged from the injection nozzle 20.

At this time, as shown in the drawing, the flow rate control valve 52 is in an open state 52*o*, and the first purging valve 62 is in a closed state 62*c*.

Resulting from momentarily opening the flow rate control valve 52 from an initial stop state, that is, a state in which the flow rate control valve 52 is in a closed state 52*c* and the first purging valve 62 is an open state 62*o*, supply of aerosol to the injection nozzle 20 can be interrupted by closing the flow rate control valve 52.

When the flow rate control valve 52 is closed, powder that has been accelerated from the initial state and raised upwards in the reservoir tank 30 is returned to the initial state again by the force of gravity.

Here, between an opening timing and a closing timing of the flow rate control valve 52, transfer gas may remain in the reservoir tank 30 and the first pipe P1. To remove such remaining transfer gas more rapidly, prevent aerosolized powder from being excessively supplied to the injection nozzle 20, and stabilize accelerated powder p more rapidly, the first purging valve 62 connected to the first suction rotary pump 61 of the purging unit 60 is opened.

Given the fact that minimizing the amount of aerosol supplied to the injection nozzle 20 and discharged from the injection nozzle 20, other than a required amount of aerosol, is the main purpose of the present invention, it is preferable that the purging unit 60 be provided with a solenoid valve that has very high responsivity similar to that of the flow rate control valve 52 of the pressure unit 50 which separates the high pressure side HP from the low pressure side LP. The process of accelerating powder p and the process of stabilizing powder p will be successively described in brief as follows with reference to FIG. 2.

When the flow rate control valve 52 is opened, compression waves or shock waves resulting from collapse of the pressure difference are transmitted from the high pressure side HP to the low pressure side LP. Then, powder p is accelerated and aerosolized by the compression waves or shock waves. Here, small particles are accelerated more rapidly than that of relatively large particles, so that particles are separated from each other by size.

Subsequently, if accelerated powder p has been transferred to the low pressure side LP in the direction of the arrows and the work has been completed, the flow rate control valve 52 is closed, and the first purging valve 62 of the purging unit 60 is opened. Then, powder p is settled with the force of gravity, and transfer gas is transferred out of the high pressure side HP by opening the first purging valve 62. The powder p is stabilized.

Furthermore, in the present invention, to more effectively disperse powder p that has been contained in the reservoir tank 30 at the initial stop state, beads b which are much larger than particles of powder p and have much higher density than powder p may be provided along with powder p in the reservoir tank 30 such that the particles of powder p can be prevented from agglomerating with each other.

In this case, when the flow rate control valve 52 is opened, the powder p which has small and low-density particles is first accelerated, while the beads b are relatively slowly accelerated compared to the powder p and thus are not transferred to the low pressure side LP, that is, to the injection nozzle 20.

As such, the beads b function to prevent powder p from agglomerating and promote aerosolization of powder p when the flow rate control valve 52 is opened.

Figure 3:
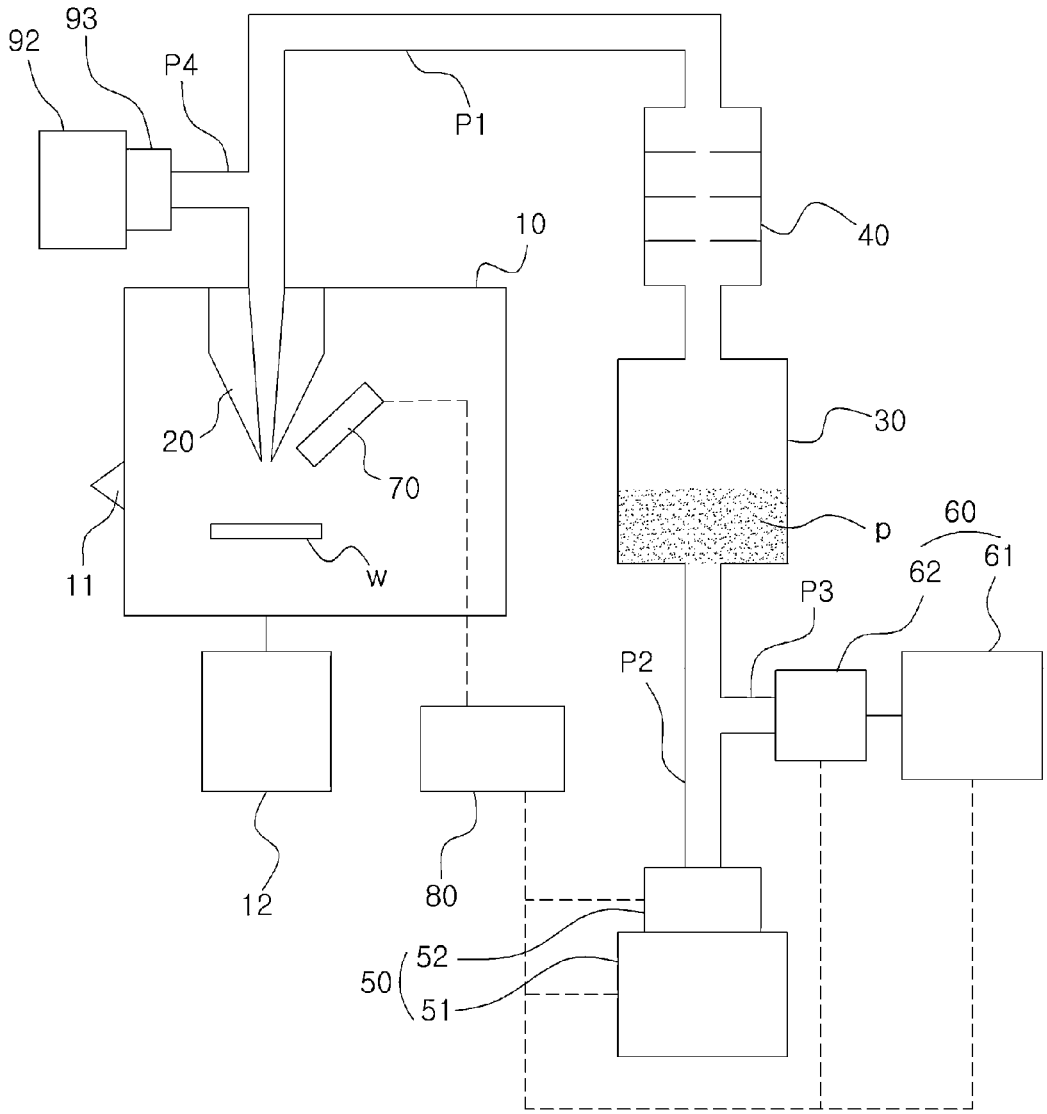
FIG. 3 is a schematic view illustrating the construction of an apparatus for transferring, focusing and purging powder for direct printing at low temperature, according to another embodiment of the present invention.

Meanwhile, as shown in FIG. 3, preferably, the apparatus according to the present invention further includes a second compressor 92 and a second purging valve 93 which are provided to effectively remove, along with the purging unit 60, transfer gas that has remained in the operation chamber housing 10, the first pipe P1, the filter 40, etc. when the pressure unit 50 is interrupted and return it out of the reservoir chamber 30. In addition, the second compressor 92 and the second purging valve 93 make it possible for powder p to be evenly dispersed and supplied without becoming stagnant.

In detail, the second compressor 92 is coupled to an end of a fourth pipe P4 which branches off from the first pipe P1 that connects the reservoir tank 30 to the operation chamber housing 10. The second compressor 92 is a technical means for generating compressed air to apply pressure to the first pipe P1.

The second purging valve 93 is provided on the fourth pipe P4 to open or close it and functions to control pressure applied from the second compressor 92 to the operation chamber housing 10 so as to remove transfer gas mixed with powder p that remains in the first pipe P1. The second purging valve 93 is a kind of solenoid valve configured such that applied air pressure can be appropriately controlled in response to the degree of opening of the valve.

The second compressor 92 and the second purging valve 93 are operated under control of the controller 80 in response to real time visual recognition information of the visual recognition unit 70.

Although it is not shown in the drawings, the apparatus according to the present invention may be provided additional purging valves to effectively and rapidly remove transfer gas that remains in aerosolized powder p.

In other words, as well as having the second purging valve 93, the apparatus of the present invention may further include an additional purging valve which is provided on the first pipe P1 or between the reservoir tank 30 and the filter 40 so as to promote rapid removal of transfer gas.

Furthermore, although it is not shown in the drawings, at least one orifice may be provided on the first pipe P1 which connects the reservoir tank 30 to the injection nozzle 20 or on the fourth pipe P4 so as to minimize the amount of transfer gas mixed with the aerosolized powder p supplied to the injection nozzle 20.

Figure 4:
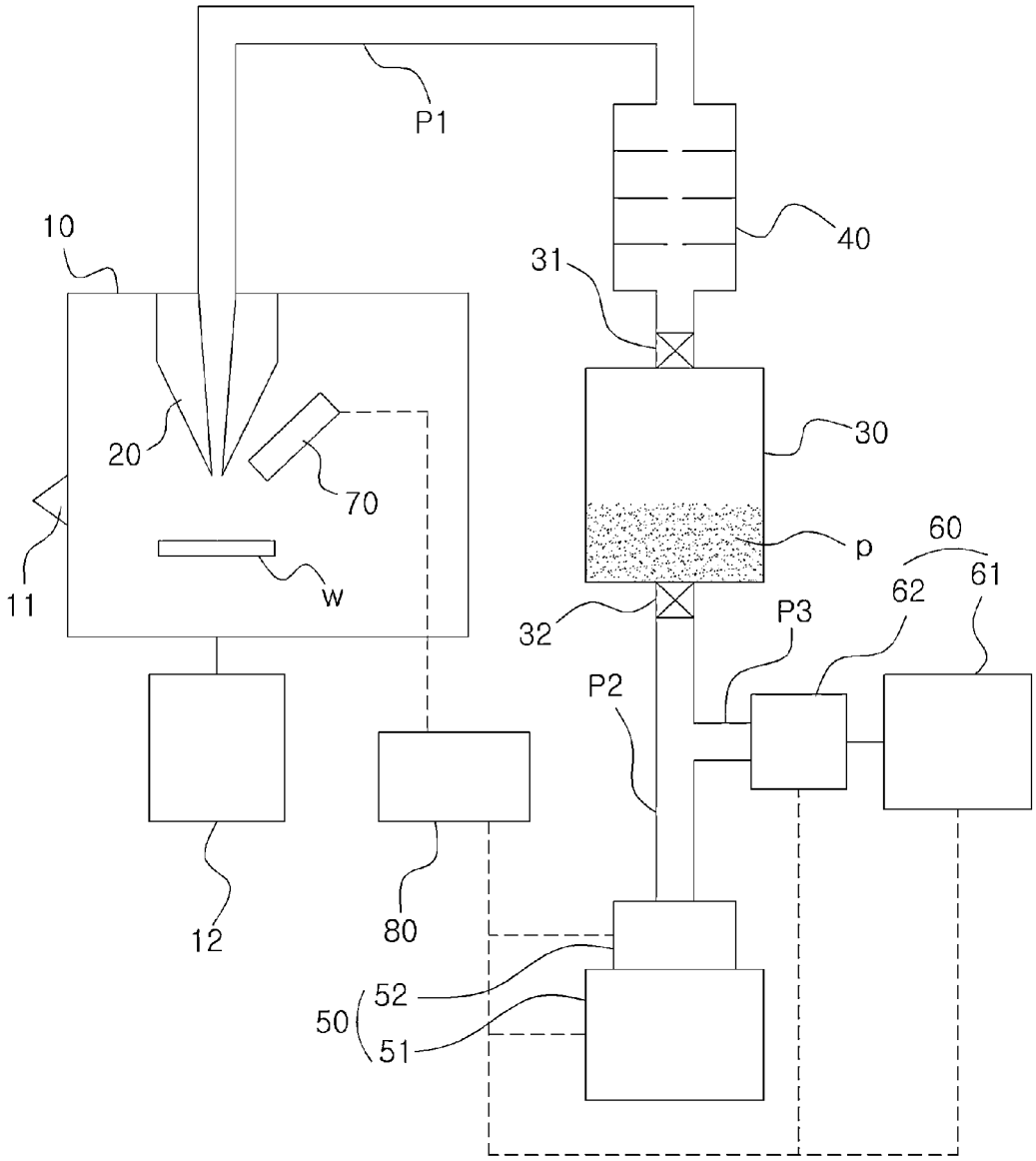
FIG. 4 is a schematic view illustrating the construction of an apparatus for transferring, focusing and purging powder for direct printing at low temperature, according to a further embodiment of the present invention.

Meanwhile, as shown in FIG. 4, preferably, the apparatus according to the present invention further includes a first mesh 31 and a second mesh 32 to prevent powder p from flowing back towards the pressure unit 50 and the purging unit 60, uniformly transfer powder p to the operating chamber housing 10 and evenly discharge powder p from the injection nozzle 20, and prevent an excessive amount of powder p from being supplied to the injection nozzle 20.

In detail, the first mesh 31 has a net shape and is provided on a first end of the reservoir tank 30 and connected to the first pipe P1 coupled to the operation chamber housing 10.

The second mesh 32 also has a net shape and is provided on a second end of the reservoir tank 30 and connected to the second pipe P2 coupled to the pressure unit 50.

The first mesh 31 has a predetermined mesh size to enable powder p to be supplied into the first pipe P1. The second mesh 32 has a predetermined mesh size to prevent powder p from entering the second pipe P2.

Figure 5:
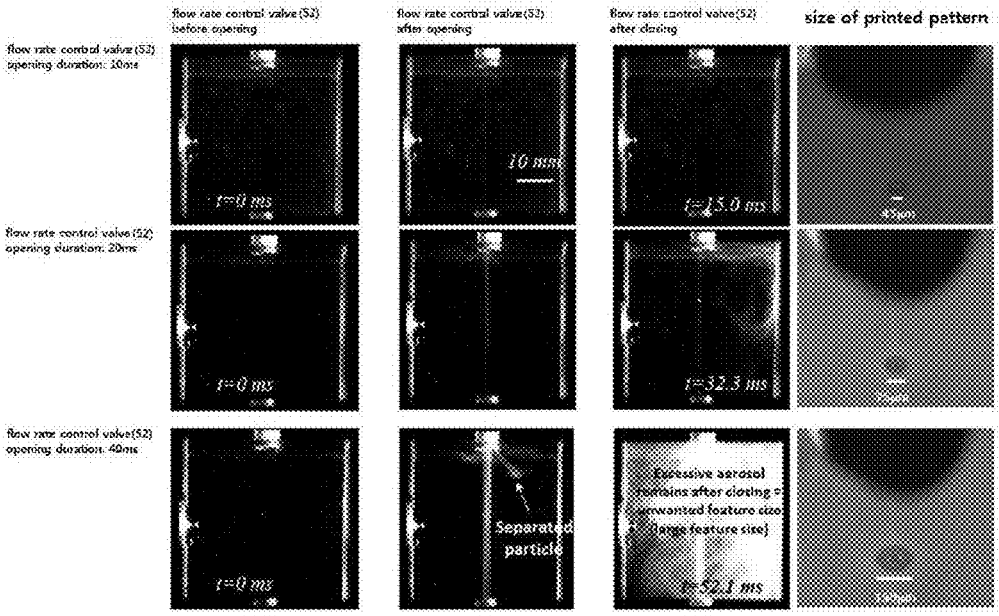
FIG. 5 is of photographs showing deposition conditions of powder on a work target as a function of time for which a pressure unit and a purging unit are opened in the powder transferring, focusing and purging apparatus according to present invention.
Figure 6:
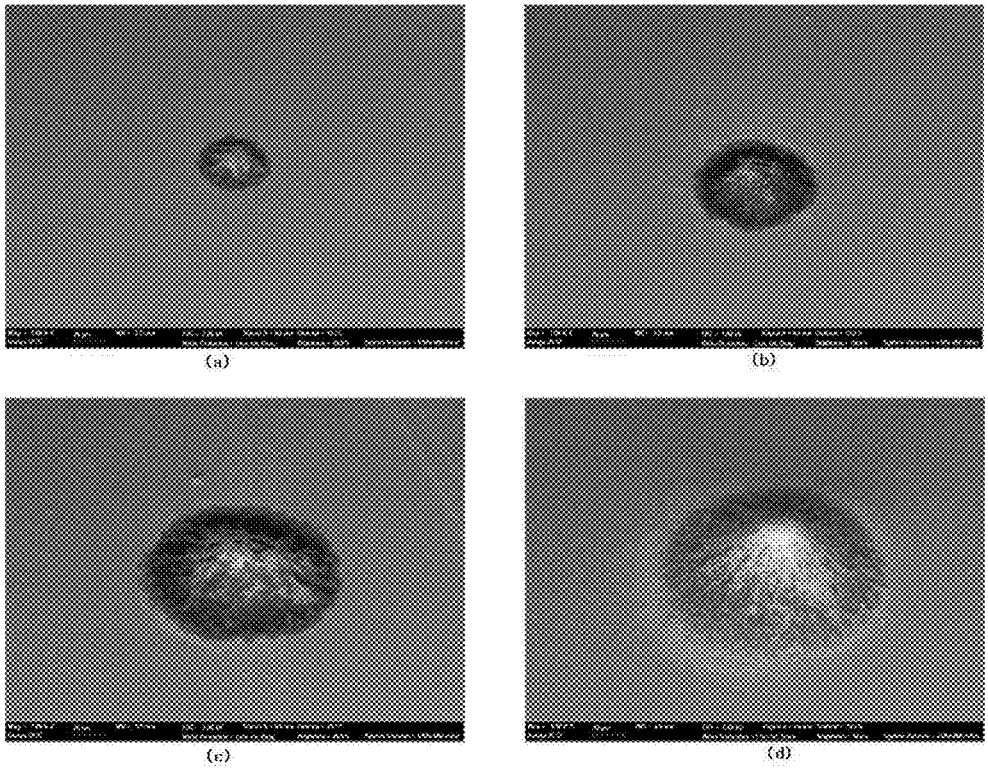
FIGS. 6A through 6D are of photographs showing deposition conditions of powder on the work target, observed by a visual recognition unit in the powder transferring, focusing and purging apparatus according to present invention.

As shown in FIGS. 5 and 6, depending on the degree of opening of the flow rate control valve 52 of the pressure unit 50, conditions in which powder p is deposited can be varied. Furthermore, the shape of a deposition result (f, refer to FIGS. 12 through 14) of powder p is determined by controlling a stage path in response to real time observation using the visual recognition unit 70 such as an optical microscope provided in the operation chamber housing 10.

When aerosolized powder p is supplied from the reservoir tank 30 to the injection nozzle 20 and applied from the injection nozzle 20 onto the work target w to form a printed pattern until the flow rate control valve 52 that has been opened is closed, the amount of aerosol, that is, the amount of transfer gas, supplied form the reservoir tank 30 to the injection nozzle 20 can be controlled to be minimized so that the size of a pattern printed on the work target w can be reduced.

Therefore, as shown in FIG. 2, the size of the pattern printed on the work target w can also be diversified by controlling a time interval between an opening timing of the flow rate control valve 52 and a closing timing thereof.

That is, the diameter of a jet of aerosolized powder p discharged onto the work target w and the size of a pattern printed by powder p deposited on the work target w, in other words, the height and diameter of the printed pattern, are proportional to the degree of opening of the flow rate control valve 52 of the pressure unit 50 and the duration for which the flow rate control valve 52 is open.

For example, when the duration of the opening of the flow rate control valve 52 was 10 ms, the size of the printed pattern was 45 μm. When the duration of the opening of the flow rate control valve 52 was 20 ms, the size of the printed pattern was 75 μm. When the duration of the opening of the flow rate control valve 52 was 40 ms, the size of the printed pattern was 150 μm. As such, it can be understood that as the duration of the opening of the flow rate control valve 52 increases, the size of the printed pattern is also increased.

As such, it can be appreciated that, as shown in FIGS. 6A through 6D, the pattern printed with powder p can have various diameters and thicknesses.

Figure 7:
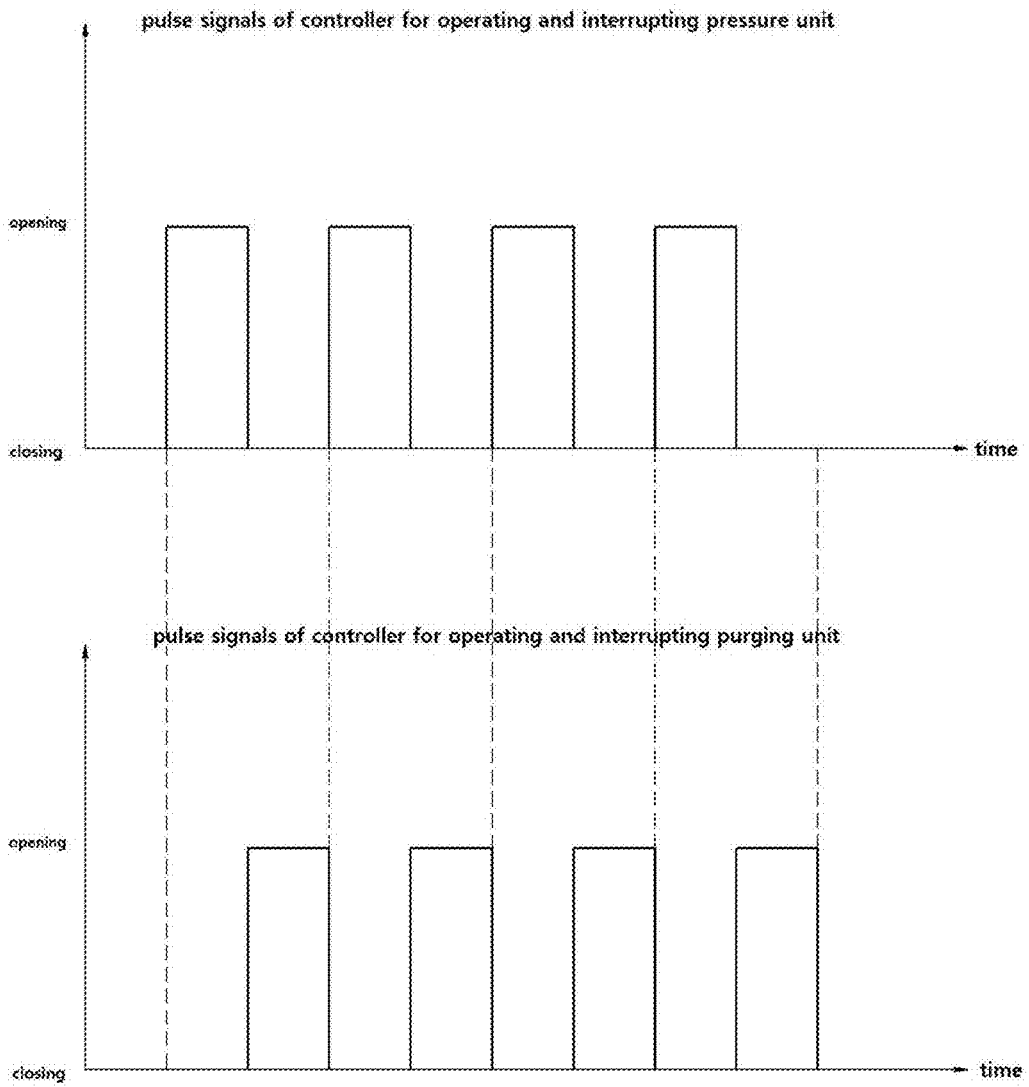
FIG. 7 is a graph showing a pattern of a series of operations in which the pressure unit and the purging unit that are critical parts of the powder transferring focusing and purging apparatus according to the present invention are alternately operated and interrupted in response to a pulse signal of a controller.

Meanwhile, to obtain such deposition result f from the powder p, operation and interruption signals of the controller 80, that is, pulse signals for operation and interruption, must be transmitted to the pressure unit 50 and the purging unit 60 at the same time such that, as shown in the graph of FIG. 7, when the pressure unit 50 is interrupted, the purging unit 60 is operated, and when the purging unit 60 is interrupted, the pressure unit 50 is operated.

Hereinafter, a method of transferring powder and purging it using the apparatus for transferring and purging powder according to the above-mentioned several embodiments of the present invention will be described with reference to FIGS. 8, 11 through 14.

Figure 8:
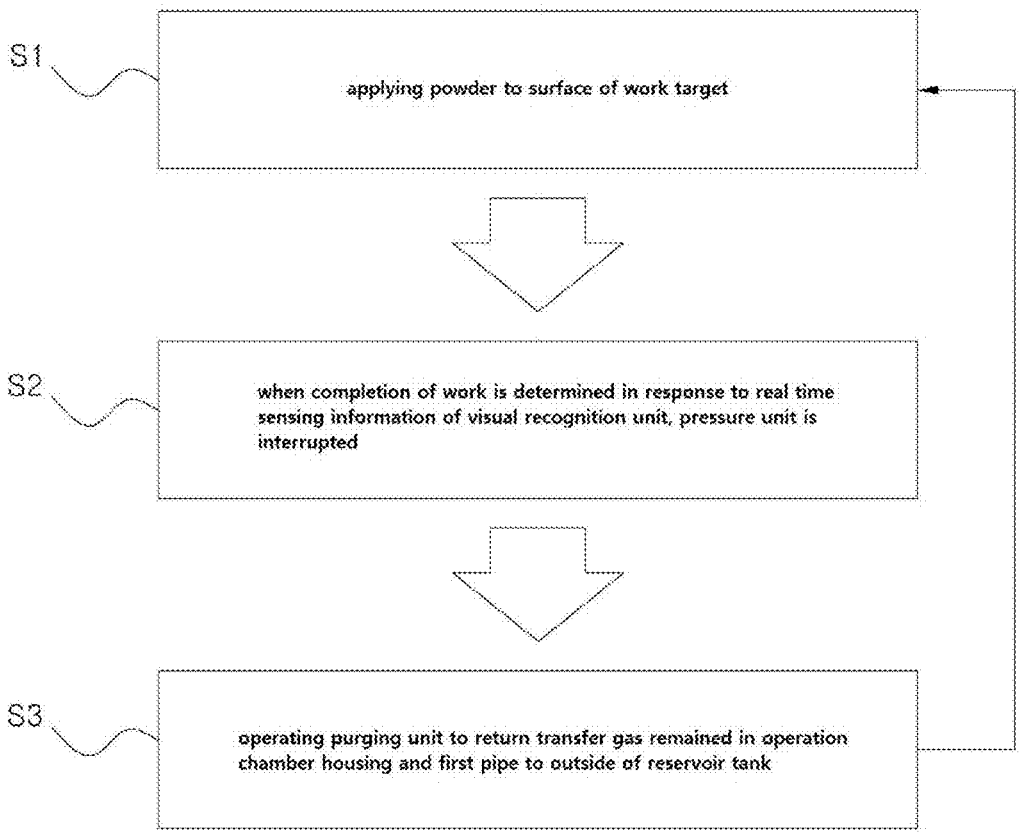
FIG. 8 is a flowchart showing a method of transferring, focusing and purging powder for direct printing at low temperature, according to an embodiment of the present invention.

As shown in FIG. 8, in present invention, a series of process of discharging powder p, stabilizing powder p and returning transfer gas mixed with the powder p at steps S1, S2 and S3 is repeatedly conducted.

At step S1, contained in the reservoir tank 30 which is connected by the first pipe P1 to the operation chamber housing 10 that is maintained at a predetermined negative pressure and which has higher internal pressure than that of the operation chamber housing 10, power p is transferred along the passage of the first pipe P1 and is discharged onto the surface of the work target w that is disposed in the operation chamber housing 10.

Here, using a pressure difference between the operation chamber housing side which is the low pressure side based on the upper and lower portions of the reservoir tank 30 and the bottom side of the reservoir tank 30 which is the high pressure side, when the pressure unit 50 connected to the reservoir tank 30 by the second pipe P2 is opened, the pressure unit 50 transmits compression waves or shock waves resulting collapse of the pressure difference from the bottom side of the reservoir tank 30 that is the high pressure side to the operation chamber housing 10 that is the low pressure side, whereby powder p is accelerated and aerosolized, and the aerosolized powder p is discharged from the injection nozzle 20 provided in the operation chamber housing 10.

At step S2, the visual recognition unit 70 provided in the operation chamber housing 10 observes in real time conditions in which powder p is applied onto the surface of the work target w and deposited thereon. When work of applying powder p on the surface of the work target w is completed in response to a preset value of the controller 80 that is electrically connected to the pressure unit 50 and the visual recognition unit 70, a signal of interrupting the operation of the pressure unit 50 is transmitted to the controller 80.

At step S3, when the operation of the pressure unit 50 is interrupted, the controller 80 transmits an operation signal to the purging unit 60 which is coupled to the end of the third pipe P3 that branches off from the second pipe P2. Then, the purging unit 60 applies suction pressure to transfer gas mixed with the aerosolized powder p that remains in the operation chamber housing 10 and the first pipe P1, so that the transfer gas returns out of the reservoir tank 30.

The operations of steps S1 through S3 are repeatedly conducted. During these steps, the controller 80 respectively transmits pulse signals to the pressure unit 50 and the purging unit 60 at the same time such that when the pressure unit 50 is interrupted, the purging unit 60 is operated, and when the purging unit 60 is interrupted, the pressure 50 is operated.

In more detail, at step S1, the first compressor 51 of the pressure unit 50 coupled to the end of the second pipe P2 is operated by an operation signal of the controller 80.

When pressure is applied by the first compressor 51 to the second pipe P2, the flow rate control valve 52 of the pressure unit 50 coupled to the second pipe P2 is opened by an opening signal of the controller 80.

As step S2, the visual recognition unit 70 senses completion of work using powder p and transmits a work completion signal to the controller 80.

Then, the flow rate control valve 52 of the pressure unit 50 coupled to the second pipe P2 is closed by a closing signal of the controller 80.

The first compressor 51 of the pressure unit 50 coupled to the second pipe P2 is also interrupted by an interruption signal of the controller 80.

When the first compressor 51 is interrupted, the operation of step S3 is immediately conducted.

In detail, at step S3, as soon as the pressure unit 50 is interrupted, the first suction rotary pump 61 of the purging unit 60 coupled to the end of the third pipe P3 is operated by an operation signal of the controller 80.

The first purging valve 62 of the purging unit 60 coupled to the third pipe P3 is opened by an opening signal of the controller 80.

Then, suction pressure is applied to powder p that remains in the operation chamber housing 10 and the first pipe P1, so that all the powder p returns to the reservoir tank 30. Thereafter, the first purging valve 62 is closed by a closing signal of the controller 80.

The first suction rotary pump 61 is also interrupted by an interruption signal of the controller 80.

As soon as the first suction rotary pump 61 is interrupted, the operation of first step S1 is conducted again.

Hereinafter, the powder transferring, focusing and purging mechanism in response to the operation and interruption of the pressure 50 and the purging unit 60 will be described.

For reference, FIGS. 9A through 9C are photographs captured by a high speed camera to show a behavior state of powder according to the time flow when the pressure unit of the apparatus for transferring, focusing and purging powder for direct printing according to an embodiment of the present invention is operated.

At an initial state (0 msec) in which the pressure unit 50 is not in operation, as shown in FIG. 9A, the powder p is in a stable state.

When the first compressor 51 is operated by an operation signal of the controller 80 and the flow rate control valve 52 is opened, compression waves (shock waves) are transmitted from the reservoir tank 30 that is the high pressure side to the operation chamber housing 10 that is the relatively low pressure side.

Then, as shown in FIG. 9B, the powder p is accelerated and aerosolized by the compression waves from the reservoir tank 30 (when 5.2 msec has passed after the flow rate control valve 52 has been opened).

Here, because small particles of the powder p are accelerated more rapidly than large particles, the particles can be separated by size and transferred according to control operation such as operation and interruption of the pressure unit 50 and operation and interruption of the purging unit 80 in response to controlling the pressure unit 50.

Before large particles of powder p are accelerated, the flow rate control valve 52 of the pressure unit 50 is closed by manipulating the controller 80. Then, the large particles of powder p are stabilized by their own weight under the force of gravity. Simultaneously, the first purging valve 62 of the purging unit 60 is opened, the remnant of the powder p is also stabilized.

That is, as shown in FIG. 9C, when 20.2 msec has passed after the flow rate control valve 52 has been opened, before large particles of powder p reach an accelerated state, the flow rate control valve 52 must be closed by manipulating the controller 80 to prevent the quality of a print from deteriorating.

Therefore, the key point of the apparatus and method for transferring, focusing and purging powder for direct printing according to the present invention is that the flow rate control valve 52 is momentarily opened so that powder p that has been in a stable state (refer to FIG. 9A) is aerosolized (refer to FIG. 9B), the open state of the flow rate control valve 52 is maintained while small particles of powder p are accelerated, and before large particles of powder p are accelerated (refer to FIG. 9C), the flow rate control valve 52 is closed and the first purging valve 62 is opened to stabilize powder p.

Figure 9:
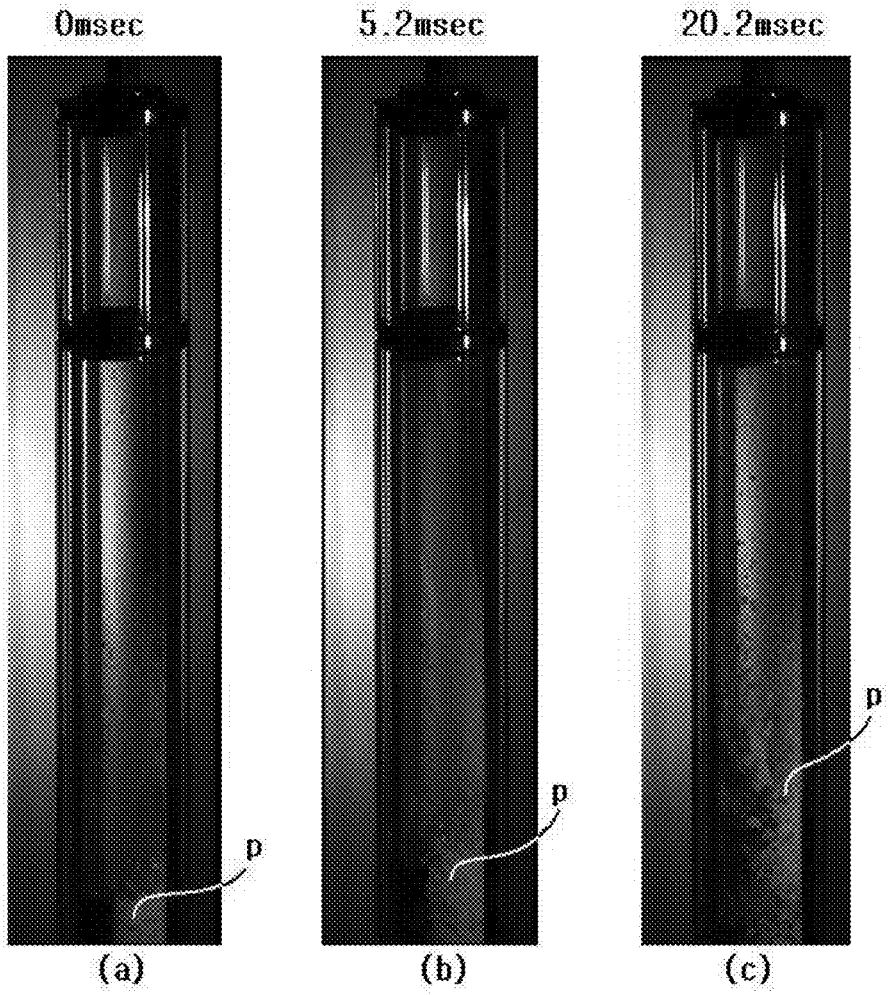
FIGS. 9A through 9C are photographs captured by a high speed camera to show a behavior state of powder according to the time flow when the pressure unit of the powder transferring, focusing and purging apparatus according to an embodiment of the present invention is operated.

From the experiment of FIG. 9 that pertains to the behavior of powder p, when the pressure of initial compression waves resulting from opening the flow rate control valve 52 is 100 pa, small particles of powder p which are about 100 nm were stabilized until about 1 msec has passed after the first purging valve 62 has been opened. On the other hand, in the case of large particles of powder p that are 1 μm, about 8.5 msec was required after the first purging valve 62 has been opened. Given this, it can be understood that it is important to precisely control the operation of the pressure unit 50 and the purging unit 60.

Hereinafter, the behavior of powder p when focused on the injection nozzle 20 and discharged therefrom will be explained.

Figure 10:
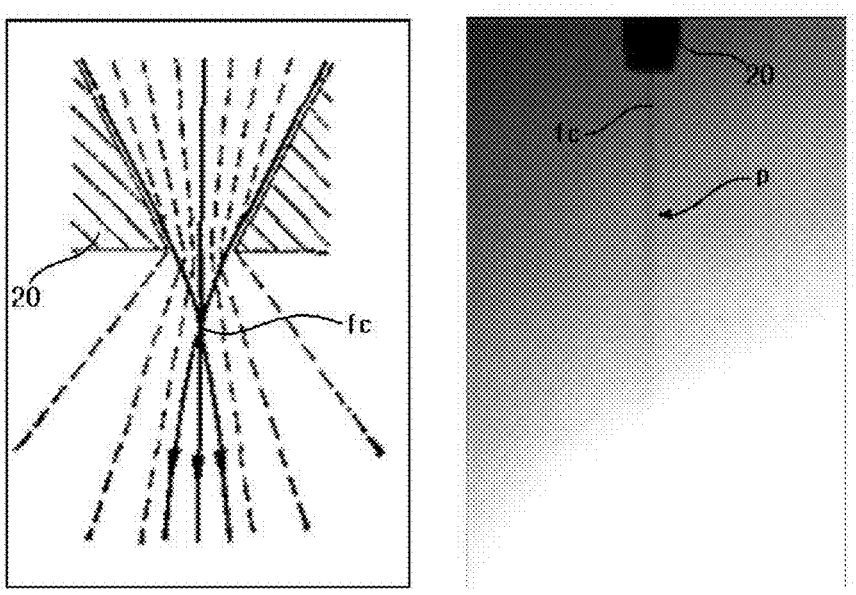

FIGS. 10A and 10B show the behavior of powder p that is focused on the injection nozzle 10 and discharged therefrom in the apparatus for transferring, focusing and purging powder for direct printing according to an embodiment of the present invention. FIG. 10A is a schematic conceptual sectional view, and FIG. 10B is a photograph showing the behavior of powder p captured by a high speed camera.

In FIG. 10A, the arrows designated by the solid lines denote the moving path of particles of powder p. The arrows designated by the dotted lines denote air the stream of air discharged from the injection nozzle by the pressure of the first compressor 51 resulting from opening the flow rate control valve 52.

Generally, when a pressure P0 just before the outlet of the injection nozzle 20 is less than or equal to a necessary minimum discharge pressure Pmin controlled by the flow rate control valve 52, particles of powder p are focused on a predetermined focus point fc, as shown in FIG. 10A.

From an experiment with the apparatus in which the diameter of the outlet of the injection nozzle 20 is 500 μm and the angle of an inner surface of the outlet of the injection nozzle 20 is 15°, it could be confirmed by high speed camera that when $BaTiO_3$ powder having a particle diameter of 100 nm is used, as shown in FIG. 10B, particles of powder p are discharged from the injection nozzle 20 in such a way that they form a focus point fc and then spread out.

A series of processes of transferring, focusing and purging powder using the powder transferring, focusing and purging apparatus according to an embodiment of the present invention will be explained in brief again with reference to FIGS. 11 through 14.

Figure 11:
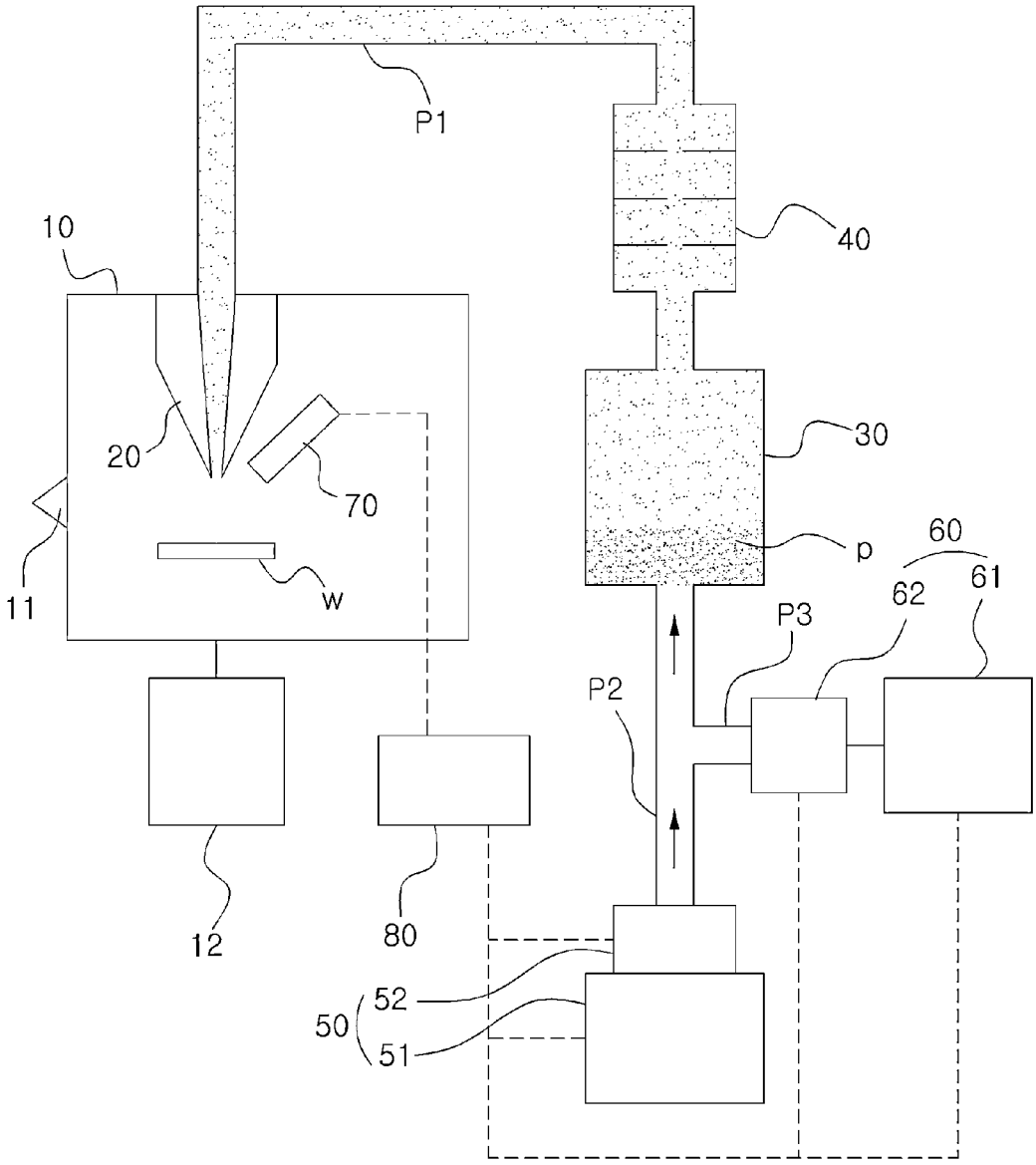
FIGS. 11 through 13 are schematic views showing a series of process of transferring and purging powder using the powder transferring, focusing and purging apparatus according to an embodiment of the present invention.

First, the controller 80 operates the first compressor 51 to generate a predetermined of pressure of compressed air. Thereafter, the flow rate control valve 52 is opened so that, as shown in FIG. 11, the pressure of compressed air is applied to the reservoir tank 30 through the second pipe p in the direction of the arrow. Then, powder p is transferred from the reservoir tank 30 to the injection nozzle 20 through the first pipe P1.

Here, the powder p is accelerated and aerosolized by compression waves, that is, shock waves, resulting from opening the flow rate control valve 52, wherein it is accelerated and aerosolized in order from the smallest particles to the biggest particles.

Figure 12:
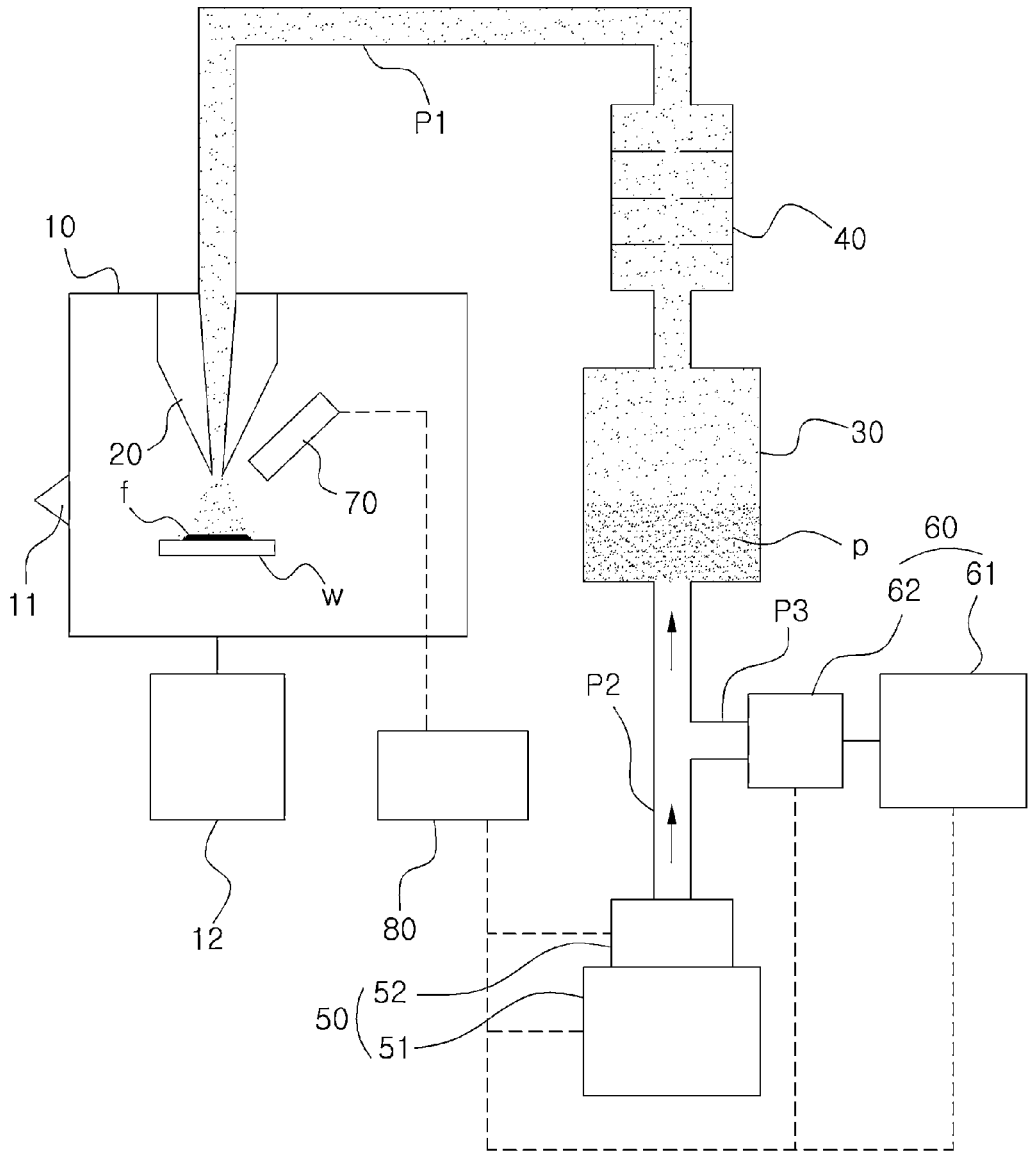

While the first compressor 51 is continuously operated and the flow rate control valve 52 is maintained in the open state, as shown in FIG. 12, powder p is discharged at high pressure from the injection nozzle 20 and applied onto the surface of the work target w disposed in the operation chamber housing 10, thus forming a deposition result f.

During this operation, the pressure formed by compressed air is continuously applied in the direction of the arrow.

The visual recognition unit 70 captures in real time images of the deposition result f formed with powder p on the surface of the work target w and successively transmits the images to the controller 80 so that the controller 80 can determine whether to interrupt the operation of the pressure unit 50 and begin the operation of the purging unit 60.

Figure 13:
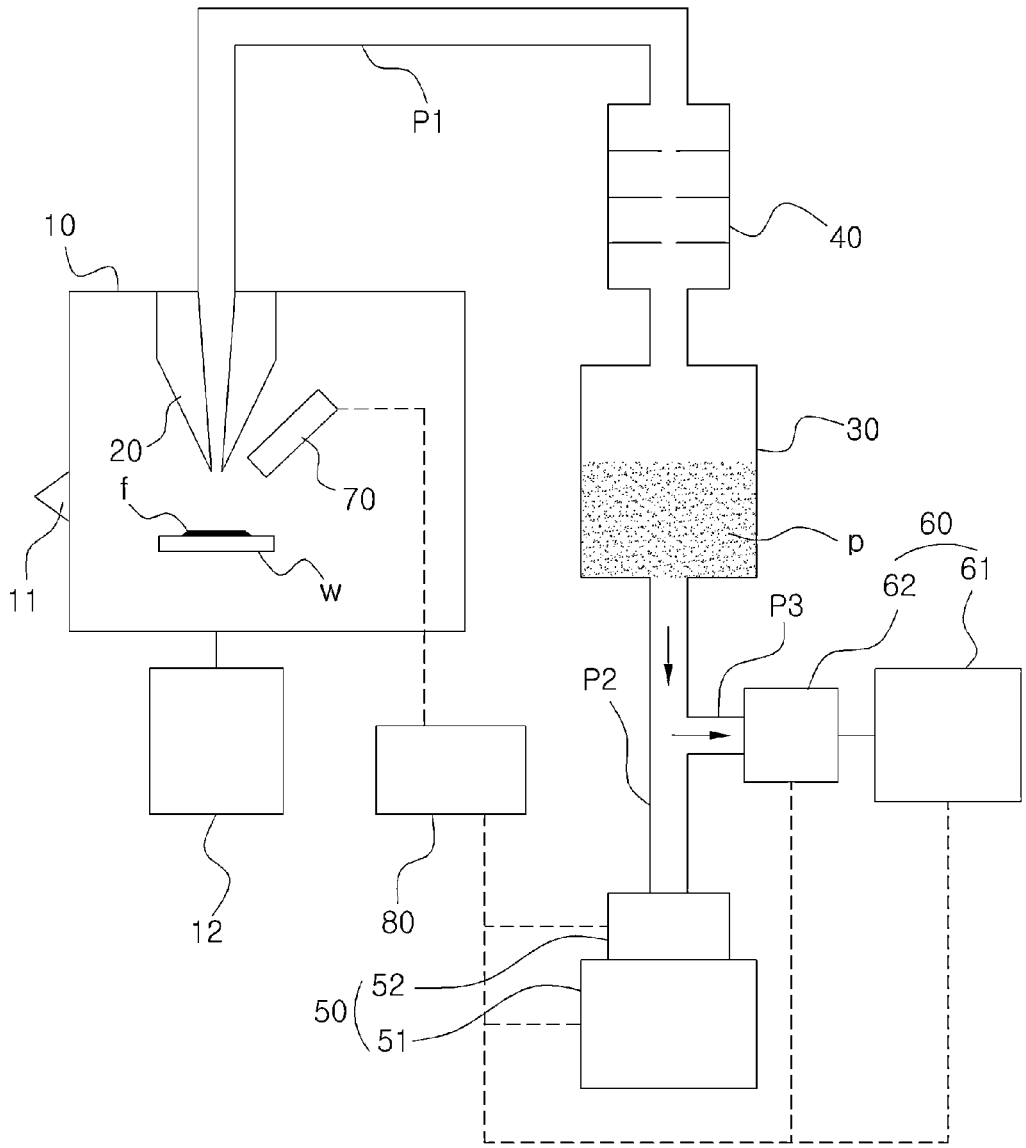

When the visual recognition unit 70 transmits an image of the completed deposition result f derived from powder p to the controller 80, before large particles of powder p are accelerated, the controller 80 closes the flow rate control valve 52 and, simultaneously, operates the first suction rotary pump 61 and opens the first purging valve 62. Then, as shown in FIG. 13, suction pressure is applied in the direction of the arrow so that powder p begins to be stabilized.

Thereafter, transfer gas mixed with the aerosolized powder p that has remained in the first pipe P1, the filter 40, etc. is returned into the reservoir tank 30 by the operation of the purging unit 60, as shown in the drawing, thus completing preparation of a subsequent operation.

Figure 14:
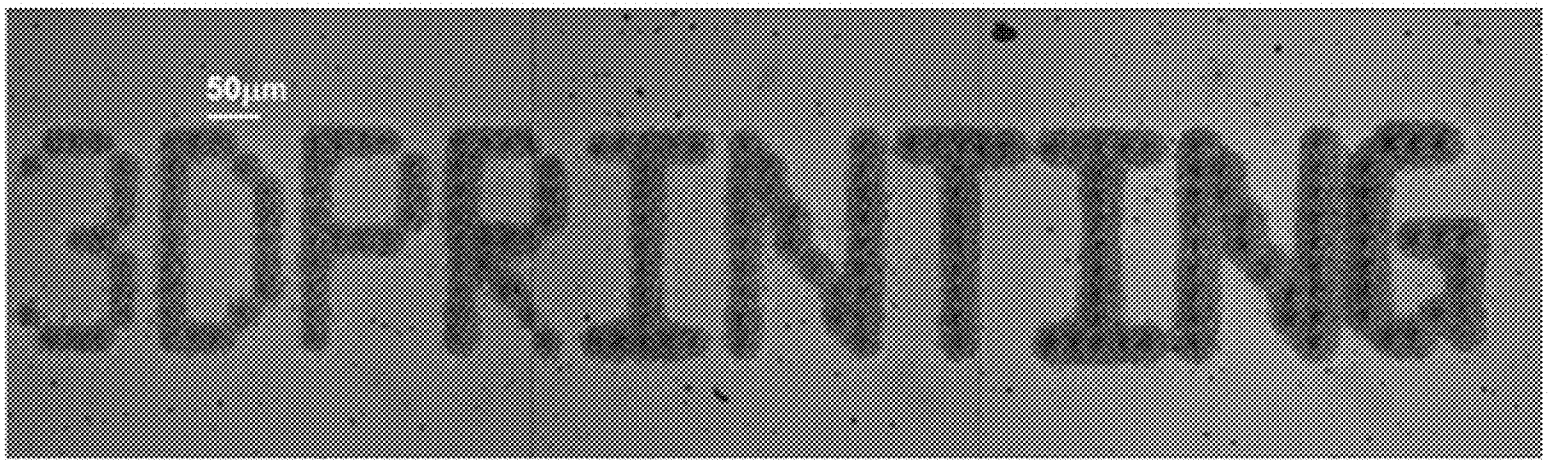
FIG. 14 is a photograph showing conditions of a pattern printed on the work target using the powder transferring, focusing and purging apparatus according to an embodiment of the present invention.

In the present invention, through the above-mentioned operations, as shown in FIG. 14, a pattern can be clearly printed on the surface of the work target w with the degree of precision of about 50 μm.

As described above, the present invention provides apparatus and method for transferring, focusing and purging powder for direct printing at low temperature which can precisely and directly print a desired pattern on a desired portion of a substrate even at low temperature in such a way that solid powder or particles are accelerated by transfer gas.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An apparatus for transferring, focusing and purging powder for direct printing at low temperature, comprising:

an operation chamber housing receiving a work target therein, the operation chamber housing having therein an internal space maintained at a negative pressure;

an injection nozzle installed in the operation chamber housing, the injection nozzle applying powder to the work target;

a reservoir tank connected to the operation chamber housing by a pipe, the reservoir tank defining an internal space for containing the powder therein, an upper portion of the internal space of the reservoir tank being at a higher pressure than a lower portion of the internal space;

a filter provided on the pipe between the operation chamber housing and the reservoir tank, the filter adjusting the amount of particles of the powder transferred from the reservoir tank into the operation chamber housing;

a pressure unit closeably connected to the reservoir tank by a pipe, the pressure unit: using a pressure difference between an operation chamber housing side that is a low pressure side based on to the upper and lower portions of the reservoir tank and a bottom side of the reservoir tank that is a high pressure side; generating a compression wave or a shock wave resulting from collapse of the pressure difference when the pressure unit is opened; and transmitting the compression wave or the shock wave to the powder, thus accelerating and aerosolizing the powder; and a purging unit connected to the reservoir tank by a pipe, the purging unit returning transfer gas that has been mixed with the aerosolized powder that remains in the operation chamber housing, the filter and the pipes to an outside of the reservoir tank after an operation of printing a pattern on the work target has been completed by closing the pressure unit, closing the pressure unit and operating the purging unit being conducted at the same time, and interrupting the purging unit and opening the pressure unit being conducted at the same time.

2. The apparatus as set forth in claim 1, wherein a degree of opening of the pressure unit and a time for which the pressure unit is open are proportional to a diameter of a jet of the aerosolized powder discharged onto the work target and a thickness and a width of the powder deposited on the work target.

3. The apparatus as set forth in claim 2, wherein the visual recognition unit comprises an optical microscope or a scanning electron microscope.

4. The apparatus as set forth in claim 1, wherein the pipes comprise:

a first pipe connecting the operation chamber housing to the reservoir tank;

a second pipe connecting the pressure unit to the reservoir tank; and a third pipe branching off from the second pipe, and the purging unit is connected to the third pipe, and the operation chamber housing is at a lower pressure than the reservoir tank.

5. The apparatus as set forth in claim 4, wherein the pressure unit comprises:

a first compressor coupled to an end of the second pipe connected to the reservoir tank; and a flow rate control valve provided on the second pipe, the flow rate control valve closing or opening the second pipe so as to isolate a pressure of air applied from the first compressor or release the pressure.

6. The apparatus as set forth in claim 4, wherein the purging unit comprises:

a first suction rotary pump connected to an end of the third pipe branching off from the second pipe connected to the reservoir tank; and a first purging valve provided on the third pipe, the first purging valve closing or opening the third pipe so as to isolate a suction pressure of air resulting from operation of the first suction rotary pump or release the suction pressure.

7. The apparatus as set forth in claim 4, further comprising:

a second compressor coupled to an end of a fourth pipe branching off from the first pipe connecting the operation chamber housing to the reservoir tank; and a second purging valve provided on the fourth pipe to open or close the fourth pipe, the second purging valve controlling a pressure that is applied from the second compressor to the operation chamber housing so as to remove the powder, stagnated in the first pipe, and compressed air, supplied from the pressure unit, from the first pipe.

8. The apparatus as set forth in claim 4, further comprising:

a first mesh coupled to a first end of the reservoir tank and connected to the first pipe coupled to the operation chamber housing; and a second mesh coupled to a second end of the reservoir tank and connected to the second pipe coupled to the pressure unit.

9. The apparatus as set forth in claim 8, wherein the first mesh has a predetermined mesh size to allow the powder to be supplied into the first pipe, and the second mesh has a predetermined mesh size to prevent the powder from entering the second pipe.

10. The apparatus as set forth in claim 1, further comprising a second suction rotary pump connected to the operation chamber housing to create a vacuum in the internal space of the operation chamber housing.

11. The apparatus as set forth in claim 1, wherein the operation chamber housing further comprises:

a support plate installed in the operation chamber housing, the work target being placed on the support plate; and a phase change assembly coupled to the support plate and installed in the operation chamber housing, the phase change assembly moving the support plate in three axis directions including front and rear directions, left and right directions and up and down directions.

12. A method for transferring, focusing and purging powder for direct printing at low temperature, comprising a first operation of: accelerating and aerosolizing powder, contained in a reservoir tank connected to an operation chamber housing having an internal space maintained at a predetermined negative pressure, the reservoir tank being at a higher pressure than the operation chamber housing, using a pressure difference between an operation chamber housing side that is a low pressure side based on upper and lower portions of the reservoir tank and a bottom side of the reservoir tank that is a high pressure side in such a way that a compression wave or a shock wave resulting from collapse of the pressure difference when a pressure unit connected to the reservoir tank by a second pipe is opened is transmitted from the bottom side of the reservoir tank that is the high pressure side to the operation chamber housing side that is the low pressure side; transferring the aerosolized powder along an internal passage of the first pipe; and applying the aerosolized powder to a surface of a work target disposed in the operation chamber housing;

a second operation of; using a visual recognition unit provided in the operation chamber housing to observe in real time conditions in which the powder is applied to the surface of the work target and deposited thereon; and transmitting a signal for interrupting the operation of the pressure unit to a controller electrically connected to the pressure unit and the visual recognition unit when work of applying the powder to the surface of the work target is completed in response to a preset value of the controller; and a third operation of transmitting an operation signal from the controller to a purging unit coupled to an end of a third pipe branching off from the second pipe when the operation of the pressure unit is interrupted, so that the purging unit returns transfer gas mixed with the aerosolized powder that has remained in the operation chamber housing and the first pipe to an outside of the reservoir tank, the first through third operations being repeatedly conducted, and the controller transmitting pulse signals to the pressure unit and the purging unit, respectively, such that interrupting the pressure unit and the operating the purging unit are conducted at the same time, and interrupting the purging unit and opening the pressure unit are conducted at the same time.

13. The method as set forth in claim 12, wherein the first operation comprises:

operating a first compressor of the pressure unit coupled to an end of the second pipe in response to an operation signal of the controller; and opening a flow rate control valve of the pressure unit in response to an opening signal of the controller when a pressure is applied to the second pipe by the first compressor, the flow rate control valve being provided on the second pipe.

14. The method as set forth in claim 13, wherein when the flow rate control valve is opened, of the powder to be injected into the operation chamber housing, relatively small particles of about 100 nm are aerosolized and accelerated while being transferred to the operation chamber housing, and just before, of the powder, comparatively large particles of about 1 μm begin to be accelerated, the flow rate control valve is closed in response to a closing signal of the controller.

15. The method as set forth in claim 12, wherein the second operation comprises:

sensing completion of the work of applying the powder using the visual recognition unit and transmitting a work completion signal to the controller;

closing the flow rate control valve of the pressure unit provided on the second pipe in response to a closing signal of the controller; and interrupting the first compressor of the pressure coupled to the end of the second pipe in response to an interruption signal of the controller, and the third operation is conducted as soon as the first compressor is interrupted.

16. The method as set forth in claim 12, wherein the third operation comprises:

operating a first suction rotary pump of the purging unit coupled to the end of the third pipe in response to an operation signal of the controller as soon as the operation of the pressure unit is interrupted; and opening a first purging valve of the purging unit coupled to the third pipe in response to an opening signal of the controller.

17. The method as set forth in claim 12, wherein the third operation comprises:

operating a first suction rotary pump of the purging unit coupled to the end of the third pipe in response to an operation signal of the controller as soon as the operation of the pressure unit is interrupted;

opening a first purging valve of the purging unit in response to an opening signal of the controller, the first purging valve provided on the third pipe;

closing the first purging valve in response to a closing signal of the controller after powder that has remained in the operation chamber housing and the first pipe is completely returned to the reservoir tank by a suction pressure applied to the powder; and interrupting the first suction rotary pump in response to an interruption signal of the controller, and the first operation is conducted as soon as the third operation is interrupted.

18. The method as set forth in claim 12, wherein the pressure unit is operated such that relatively small particles of the powder to be injected into the operation chamber housing are aerosolized and accelerated until comparatively large particles of the powder are accelerated.

19. The method as set forth in claim 12, wherein a degree of opening of the pressure unit and a time for which the pressure unit is open are proportional to a diameter of a jet of the aerosolized powder discharged onto the work target and a thickness and a width of the powder deposited on the work target.

* * * * *